US010184633B2

(12) United States Patent
Feil et al.

(10) Patent No.: US 10,184,633 B2
(45) Date of Patent: Jan. 22, 2019

(54) MODULE, SET OF POSITIONING ELEMENTS, ARRANGEMENT HAVING A MODULE, HEADLAMP AND METHOD FOR PRODUCING A MODULE

(71) Applicant: OSRAM GmbH, Munich (DE)

(72) Inventors: Thomas Feil, Iggingen (DE); Andreas Hartmann, Ulm (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 15/874,924

(22) Filed: Jan. 19, 2018

(65) Prior Publication Data

US 2018/0202625 A1 Jul. 19, 2018

(30) Foreign Application Priority Data

Jan. 19, 2017 (DE) ..... 10 2017 101 008

(51) Int. Cl.

| | |
|---|---|
| ***F21V 17/02*** | (2006.01) |
| ***F21S 41/29*** | (2018.01) |
| ***F21S 41/176*** | (2018.01) |
| ***F21V 9/32*** | (2018.01) |

(52) U.S. Cl.

CPC ..... *F21S 41/29* (2018.01); *F21S 41/176* (2018.01); *F21V 9/32* (2018.02); *F21V 17/02* (2013.01)

(58) Field of Classification Search

CPC ..... F21S 41/29; F21S 41/176; F21V 17/02; F21V 9/32

See application file for complete search history.

(56) References Cited

U.S. PATENT DOCUMENTS

| | | | | |
|---|---|---|---|---|
| 2003/0223245 | A1 | 12/2003 | Abe | |
| 2009/0251918 | A1* | 10/2009 | Engl | F21V 7/0091 362/555 |
| 2013/0188376 | A1* | 7/2013 | En | F21V 21/34 362/510 |
| 2014/0169024 | A1 | 6/2014 | Hager et al. | |
| 2017/0153002 | A1* | 6/2017 | Sommerschuh | F21V 29/502 |

FOREIGN PATENT DOCUMENTS

| | | |
|---|---|---|
| DE | 603 20 336 T2 | 5/2009 |
| DE | 10 2012 201 307 A1 | 8/2013 |
| DE | 10 2012 223 854 A1 | 6/2014 |
| DE | 20 2015 001 682 U1 | 3/2015 |
| WO | 2013113547 A1 | 8/2013 |

OTHER PUBLICATIONS

German Search Report based on application No. 10 2017 101 008.4 (8 pages) dated May 17, 2017 (for reference purpose only).

* cited by examiner

*Primary Examiner* — Donald L Raleigh

(74) *Attorney, Agent, or Firm* — Viering Jentschura & Partner MBB

(57) ABSTRACT

A module may include a housing in which a radiation source is arranged, where the radiation source is configured to emit an excitation radiation by virtue of a conversion element disposed downstream of the radiation source, and the conversion element is configured to convert, at least in part, the excitation radiation. The conversion element may be fastened to a holding section of the housing. The holding section may be encompassed by a positioning element. A receptacle of a component may be adapted to the positioning element. The component may be downstream of the module. The housing may be positionable in the receptacle in order to position the component with respect to an impingement region of the excitation radiation on the conversion element.

15 Claims, 3 Drawing Sheets

MODULE, SET OF POSITIONING ELEMENTS, ARRANGEMENT HAVING A MODULE, HEADLAMP AND METHOD FOR PRODUCING A MODULE

CROSS-REFERENCE TO RELATED APPLICATION

This application claims priority to German Patent Application Serial No. 10 2017 101 008.4, which was filed Jan. 19, 2017, and is incorporated herein by reference in its entirety and for all purposes.

TECHNICAL FIELD

Various embodiments relate generally to a module, e.g. a laser activated remote phosphor (LARP) module. Furthermore, various embodiments relate to a set of positioning elements for a module. Additionally, an arrangement having a module and a further component, such as e.g. an optics unit, is disclosed. Further, various embodiments relate to a headlamp. Moreover, a method for producing a module is provided.

BACKGROUND

A conventional LARP module employs LARP technology. In this technology, a conversion element that is arranged at a distance from a radiation source and that has, or consists of, a phosphor is irradiated by excitation radiation, e.g. an excitation beam or pump beam or pump laser beam, e.g. by the excitation beam of a laser diode. The excitation radiation is at least partly absorbed by the phosphor and at least partly converted into conversion radiation or into conversion light, the wavelengths of which and hence the spectral properties and/or color of which are determined by the conversion properties of the phosphor. In the case of the down conversion, the excitation radiation of the radiation source is converted by the irradiated phosphor into conversion radiation with longer wavelengths than the excitation radiation. By way of example, this allows blue excitation radiation, e.g. blue laser light, to be converted into red and/or green and/or yellow conversion radiation with the aid of the conversion element. In the case of a partial conversion, white used light arises, for example, from a superposition of non-converted blue excitation light and yellow conversion light.

The LARP module has a block-shaped housing, a circular cylindrical, socket-shaped holding section for a conversion element extending away from said housing. Here, the holding section encompasses the beam path between a radiation source and the conversion element which is arranged approximately at the end side of a free end section of the holding section. Here, a nominal position for the laser spot on the phosphor lies on the longitudinal axis of the holding section and is consequently provided in the center of the phosphor. Due to manufacturing processes and on account of tolerances, it is possible that the excitation radiation does not impinge on the phosphor at the theoretical nominal position. As a result of this, an offset arises between the laser spot and the nominal position. However, the optical elements disposed downstream of the LARP module must be positioned as accurately as possible in respect of the actually occurring position of the laser spot.

SUMMARY

A module may include a housing in which a radiation source is arranged, where the radiation source is configured to emit an excitation radiation by virtue of a conversion element disposed downstream of the radiation source, and the conversion element is configured to convert, at least in part, the excitation radiation. The conversion element may be fastened to a holding section of the housing. The holding section may be encompassed by a positioning element. A receptacle of a component may be adapted to the positioning element. The component may be downstream of the module. The housing may be positionable in the receptacle in order to position the component with respect to an impingement region of the excitation radiation on the conversion element.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the present disclosure. In the following description, various embodiments of the present disclosure are described with reference to the following drawings, in which.

DESCRIPTION

Figure 1:
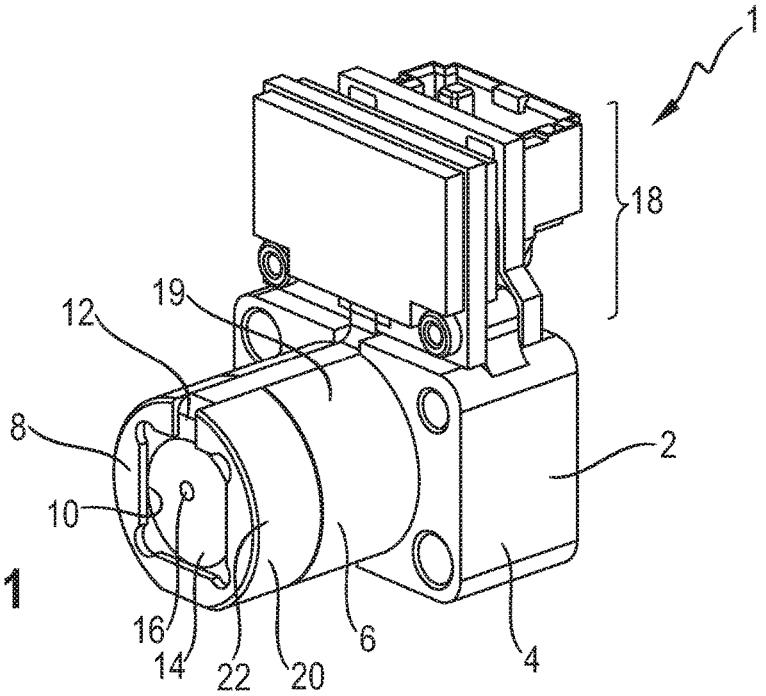
FIG. 1 shows a perspective illustration of part of a module according to an embodiment.

The following detailed description refers to the accompanying drawings that show, by way of illustration, specific details and embodiments in which various aspects of the present disclosure may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments develop a module with which elements that are disposed downstream, e.g. optics, are easily positionable. Further, various embodiments provide a set with positioning elements which facilitate simple positioning of elements disposed downstream of the module. Furthermore, various embodiments provide an arrangement and a headlamp having a module, the elements of which arrangement and headlamp are easily positionable in respect of one another. Moreover, various embodiments provide a method for producing a module, by means of which simple positioning of elements disposed downstream of the module is facilitated.

In various embodiments, provision is made of a module, e.g. an LARP module, or a laser activated remote phosphor (LARP) light source. In various embodiments, the latter has a housing in which a radiation source, e.g. a laser light source or a laser diode, e.g. a laser diode emitting blue light, is arranged, e.g. if an LARP module is provided as the module. It would also be conceivable to provide a light-emitting diode (LED), e.g. a blue-light-emitting LED as the radiation source. An excitation radiation is emittable by means of the radiation source. Moreover, provision may be made for a conversion element, which, e.g., has a phosphor or is formed therefrom, to be arranged in the housing. Said conversion element may be arranged downstream of the radiation source and at least partly, or completely, convert the excitation radiation. In various embodiments, the conversion element is fastened to a holding section of the housing. In various embodiments, the holding section, which may form part of the housing, is encompassed by a positioning element. By means of said positioning element, the housing can be positionable in a receptacle, provided for the positioning element, of a component or, conversely, the component with its receptacle can be positioned at the housing by way of the positioning element.

In this solution, a positioning element is provided between the housing, e.g. its holding section, and the downstream component. As a consequence, it is not necessary, for example, to correct a downstream component, such as e.g. downstream optics, in respect of the position thereof with much outlay should a laser spot of the excitation radiation, as explained at the outset, deviate from a nominal position. Instead, a deviation from the nominal position can be taken into account by means of the positioning element. Consequently, no active positioning, for example of downstream optics, is required in order to match the latter to the position of the laser spot. Nor are references or mechanical references provided in the housing, which may be defined in advance, necessary in order to position the housing in respect of the downstream component. Such references, which are no longer necessary, may be introduced after the position of the laser spot impinging on the phosphor has been measured, wherein the references are then used to position the housing in relation to the downstream component. Moreover, as a result of the positioning element according to various embodiments, it is not necessary to modify the position of the laser spot on the phosphor by way of an optical system provided between the radiation source and the phosphor.

By way of example, the laser spot is circular, elliptical or free-form. In various embodiments, the laser spot is elliptical (fast axis, slow axis) with a Gaussian intensity distribution. Typical laser spot diameters lie in the range from 50 to 200 μm, wherein it is conceivable for these to be smaller or larger.

The input coupling area of the phosphor or of the conversion element may be oriented perpendicular to the optical axis of the radiation source. Alternatively, it is conceivable to arrange the input coupling area in an oblique fashion in relation to the optical axis. By way of example, the input coupling area has a plane or convex or outwardly curved embodiment.

In various embodiments, the position of the positioning element may be adjustable, e.g. after the current position of the laser spot of the excitation radiation on the phosphor has been determined. As an alternative to adjusting the position of the positioning element, it is also conceivable to use a certain type of positioning element from among different types of positioning elements, wherein the selection of the positioning element is effectuated depending on a deviation of the current position of the laser spot in relation to a nominal position.

In various embodiments, the receptacle of the downstream component is adapted to the positioning element, as a result of which a change in position of the positioning element consequently leads to a change in position of the downstream component.

In a manner that is simple in terms of the apparatus, the positioning element may have an outer abutment area for positioning within the corresponding receptacle of the downstream component. In that case, the abutment area may be embodied by a section or by a plurality of sections of a circular cylindrical area or the abutment area may be embodied as a circular cylindrical area. Then, the center point of the circular cylindrical area or the longitudinal axis thereof may extend through an impingement region of the excitation radiation or through the laser spot of the excitation radiation on the conversion element. In various embodiments, the longitudinal axis extends through the center of the impingement region or laser spot. Consequently, the circular cylindrical area or the outer abutment area may be arranged in respect of the actual position of the laser spot on the phosphor in such a way that said laser spot is arranged centrally in relation to the abutment area. Consequently, a downstream component can easily be positioned by virtue of the outer abutment area simply serving as reference area for the downstream component. In various embodiments, the longitudinal axis of the circular cylindrical area extends with parallel spacing from the principal emission axis of the radiation source. Further, the diameter of the abutment area of the positioning element may be the same, independently of the arrangement of the longitudinal axis thereof.

By way of example, the positioning element is socket-shaped and may encompass the holding section.

In a manner that is simple in terms of the apparatus, the holding section may simply have a socket-shaped configuration and encompass the beam path between the radiation source and the conversion element and/or the principal emission axis of the radiation source. Consequently, the holding section is, for example, a holding socket. It is conceivable to design the latter to have multiple parts.

In various embodiments, the housing may have a block part. Then, the radiation source may be arranged in the latter. Then, the holding section, e.g. the socket-shaped holding section, may extend away from a side area of the block part, e.g. in the direction of the principal emission axis of the radiation source. Then, the holding section may have an end section spaced apart from the block part, said end section in turn having an opening. The conversion element may be arranged in said opening.

In various embodiments, the holding section has an outer lateral area, which is formed at least by a section or by a plurality of sections of a circular cylindrical area or is formed as a circular cylindrical area. In various embodiments, the outer lateral area can easily be used as reference surface in order to determine the deviation of the actual position of the laser spot from the nominal position. e.g., this renders it possible to capture a distance of the laser spot of the excitation radiation from the center point of the cross section of the outer lateral area of the holding section in the radial direction. Furthermore, it is possible, in the process, to capture a deviation direction of the laser spot of the excitation radiation from the center point of the cross section of the outer lateral area of the holding section in the radial direction. On the basis of the captured distance and the captured deviation direction, it is possible to position the positioning element or select the desired type of positioning element. Consequently, the positioning element can easily be positioned depending on the distance and the deviation direction. If different positioning elements from a set of positioning elements are provided for different distances, the appropriate positioning element may be selected depending on the distance and on the deviation direction.

In various embodiments, the distance and the deviation direction are measured at room temperature or at an operating temperature. In various embodiments, the positioning element compensates the offset, i.e. the distance and the deviation direction, at the operating temperature.

According to various embodiments of the positioning element, the latter has an inner abutment area in order, thereby, to be arranged on the lateral area of the holding section. Here, the inner abutment area is formed by a section or by a plurality of sections of a circular cylindrical area or it is formed as a circular cylindrical area. The longitudinal axes of the inner abutment area and the outer abutment area of the positioning element may extend with a parallel spacing from one another or they may be coaxial. In the case of an extent with a parallel spacing from one another, the abutment areas are preferably arranged eccentrically in relation to one another. Consequently, the size of the eccentricity of the positioning element allows compensation of the distance of the position of the actual laser spot from the nominal position on the phosphor. As a result of the eccentricity of the abutment area, the spacing thereof changes in the circumferential direction. Here, the largest spacing of the abutment areas lies in the deviation direction of the actual position of the laser spot in relation to the nominal position on the phosphor. Consequently, the deviation direction can be taken into account easily by appropriate positioning of the positioning element in relation to the holding section in the circumferential direction. Then, the positioning element may be positioned in respect of the holding section in such a way that the actual position of the laser spot may be arranged centrally in relation to the outer abutment area of the positioning element.

In various embodiments, an axial length of the positioning element approximately corresponds to an axial length of the holding section.

In various embodiments of the positioning element, the latter has an inner lateral area. Play may be provided between said inner lateral area and the outer lateral area of the holding section. As a result of this, the positioning element may be changeable in respect of the holding section, e.g. in a plane that extends transversely to the principal emission axis. As a result, a displacement of the positioning element in this plane allows said positioning element to be adjusted in such a way that the position of the laser spot on the phosphor is arranged centrally in relation to the outer abutment area of the positioning element. After adjusting the positioning element, the latter may then be securely connected to the housing.

As already explained above, the positioning element, in a manner that is simple in terms of the apparatus, may be securely connected to the housing, e.g. to the holding section. If the inner abutment area of the positioning element and the outer lateral area of the holding section are matched to one another, it is conceivable to fasten the positioning element on the holding section with a press fit, wherein this is preferably provided in the case of the eccentric positioning element. Alternatively, or additionally, provision can be made for the positioning element to be welded and/or adhesively bonded and/or soldered and/or connected, using another joining method, to the housing, e.g. the holding section.

In a further configuration of the present disclosure, the positioning element may have a marking. Consequently, this facilitates better manageability of the positioning element since it is possible to determine a position more easily and more accurately by way of the marking. If the positioning element has an eccentric configuration, the marking may be provided at, for example, the thinnest or thickest wall region of the positioning element. e.g., the marking is a recess which is introduced from an end face of the positioning element.

The conversion element which has the phosphor or which is formed therefrom may be arranged on a substrate which is then, in turn, fastened in the holding section. In various embodiments, provision is made of a transmissive arrangement, whereby an input coupling side of the conversion element, on which excitation radiation is coupled in, differs from an output coupling side, from which used light is then decoupled.

In various embodiments, provision is made of a set with a plurality of different positioning elements for a module according to one or more of the preceding aspects. Here, a respective positioning element may have an outer abutment area and an inner abutment area. These may be respectively formed by a section or by a plurality of sections of a circular cylindrical area or they may be respectively embodied as a circular cylindrical area. In various embodiments, provision is then made for the longitudinal axes of the inner abutment area and the outer abutment area to respectively extend with a parallel spacing from one another in the plurality of positioning elements, as a result of which it is possible to provide positioning elements with different eccentricities. Alternatively, it is possible to provide for the longitudinal axes of the inner abutment areas and the outer abutment areas to extend with a parallel spacing from one another in at least one positioning element and for the longitudinal axes of the inner abutment area and of the outer abutment area to be coaxial in one positioning element. Consequently, at least one positioning element may have eccentricity in this case and the other positioning element may have no such eccentricity.

The plurality of different positioning elements preferably differ in terms of spacing between the longitudinal axes of the inner abutment area and the outer abutment area. Furthermore, the different positioning elements may be configured in accordance with one or more of the preceding aspects, which were explained when discussing the module.

By way of example, if the position of the laser spot is intended to be arranged within a tolerance of +/−0.2 mm in respect of the nominal position after the assembly of the module, five different positioning elements may be provided for a positioning accuracy of +/−25 μm. Consequently, the spacing between the longitudinal axes of the outer and inner abutment areas is e.g. 50 μm in one case, 100 μm in one case, 150 μm in one case and 200 μm in one case, and provision is made of a positioning element in which the longitudinal axes are arranged coaxially in relation to one another. Then, by way of example, the positioning element without eccentricity is used in the case of deviations of the laser spot of +1-25 μm; the positioning element with 50 μm is used in the case of deviations of the laser spot from −75 μm to −25 μm and +25 μm to +75 μm, etc. If, additionally, provision is made of a positioning element with a spacing of the longitudinal axes of 25 μm, then this can lead to a positioning accuracy of +/−12.5 μm in the range of deviations of the laser spot between +/−50 μm. Consequently, it is shown in an exemplary manner that a desired positioning accuracy in a specific tolerance range is easily implementable on the basis of a small number of different positioning elements and on the basis of a certain gradation of the eccentricities. Naturally, different spacings and a different number of different positioning elements are also possible.

According to various embodiments, an arrangement with a module according to one or more of the preceding aspects is provided.

In various embodiments, the arrangement has a component having a receptacle in order to receive the positioning element. By way of example, the receptacle has an abutment area for the positioning element for the purpose of defined positioning.

The abutment area of the component of the arrangement can be formed by a section or by a plurality of sections of a circular cylindrical area or by a circular cylindrical area. In various embodiments, the abutment area is formed by two such sections that lie opposite one another. Consequently, the abutment area can encompass the outer abutment area of the positioning element. The diameter of the abutment area of the receptacle and the diameter of the outer abutment area of the positioning element may be the same or within a desired tolerance range.

In various embodiments, the component can be secured on the housing after inserting the housing with the positioning element into the receptacle. In various embodiments, the abutment area of the component encompasses the positioning element, e.g. approximately without play.

A fastening recess or a plurality of fastening recesses for fastening the housing and/or for fastening the component on the housing may be formed in the housing, e.g. in the block part. Here, the at least one fastening recess is configured in such a way that the component is displaceable within a certain range in a plane and nevertheless fastenable to the fastening recess. Consequently, it is possible to use different positioning elements, wherein the component can be fastened by way of the at least one fastening recess despite these different positioning elements. By way of example, a diameter of the fastening recess is selected in such a way that the component, as explained above, is fastenable at different positions in a plane which extends transversely to the principal emission axis. In various embodiments, the at least one fastening recesses has a continuous configuration. A longitudinal axis of the at least one fastening recess may extend with approximately parallel spacing from the principal emission axis.

According to various embodiments, provision is made of a headlamp, e.g. for a vehicle, having an arrangement according to one or more of the preceding aspects.

The vehicle may be an aircraft or a water-based vehicle or a land-based vehicle. The land-based vehicle may be a motor vehicle or a rail vehicle or a bicycle. The use of the vehicle headlamp in a truck or an automobile or a motorcycle may be provided.

Further fields of application may be, for example, lamps for effect lighting illuminations, entertainment illuminations, architainment illuminations, general illumination, medical and therapeutic illumination, horticulture, etc.

In a method according to various embodiments for producing or assembling a module according to one or more of the preceding aspects or an arrangement, the processes set forth below may be provided:

measuring a distance between the impingement region of the excitation radiation on the conversion element and the center point of the cross section of the outer lateral area of the holding section in the radial direction, measuring a deviation direction of the impingement region proceeding from the center point of the cross section of the outer lateral area, selecting a positioning element from the set according to one or more of the preceding aspects or arranging a circular ring-shaped positioning element, which encompasses the holding section with play.

Consequently, this method can be used to produce, in a manner that is very simple in terms of the apparatus, a module for insertion into a receptacle of a component, such as e.g. an optics holder for optics.

If necessary, the positioning element can be fastened to the housing as a next process.

In a further method process, the module can be placed into the receptacle of the component by way of the positioning element. Then, the component can be fastened to the housing or the housing can be fastened to the component.

According to FIG. 1, a module in the form of an LARP module 1 is illustrated, wherein, as already explained above, it is conceivable to alternatively provide a blue-light-emitting diode (LED) in the module. Said module has a housing 2 which has a block part 4 and an approximately circular cylindrical holding section 6 that extends away therefrom. A radiation source in the form of a laser diode is arranged in the block part 4, said laser diode emitting excitation radiation in the form of laser light via the holding section 6. The socket-shaped holding section 6 has a base area 8 at its end part facing away from the block part 4, said base area having a quadrilateral recess 10 with rounded corners. Said recess serves as an opening, upstream of which there is a substrate 12 with a phosphor 14. The substrate 12 is arranged within the holding section 6 and it is arranged adjacent to the base area 8 or adjoins the latter. The excitation radiation of the laser diode impinges on the phosphor and excites the latter, wherein, according to FIG. 1, an impingement region 16 or laser spot of the excitation radiation on the phosphor 14 is illustrated. The excitation radiation is converted into conversion radiation, at least in part or else completely. If there is a partial conversion, the conversion radiation together with non-converted excitation radiation may yield a used light. In the case of a complete conversion, the used light is formed completely out of the conversion radiation. The used light can emerge from the LARP module 1 via the recess 10.

Moreover, an actuation and electrical contacting are illustrated according to FIG. 1; this is provided with reference sign 18.

The holding section 6 has a two-part configuration and has a ring section 19 between the block part 4 and an end section 20, which ring section, in turn, has the base area 8. Overall, the holding section 6 has an approximately outer lateral area 22 which is embodied as a circular cylindrical area. The position of the impingement region 16 is measured with respect thereto. To this end, a nominal position, which is the center point of the outer lateral area 22, is initially set. Then, a distance between the nominal position and the actual impingement region 16 is captured in respect of said nominal position. Furthermore, a deviation direction of the impingement region 16 in respect of the nominal position is captured. Then, a certain positioning element 24, see FIG. 2*a* and FIG. 2*b*, is selected and arranged on the holding section 6 depending on the distance and the deviation direction of the impingement region 16 from the nominal position.

The positioning element 24 is configured as a sleeve which has a circular cylindrical outer abutment area 26 and a circular cylindrical inner abutment area 28. Here, the inner abutment area 28 rests approximately on the outer lateral area 22, see FIG. 1, of the holding section 6.

Figure 3A:
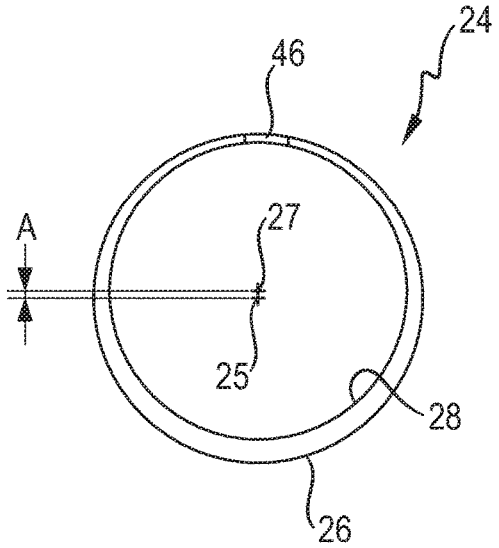
FIGS. 3*a* and 3*b* show different illustrations of a positioning element.
Figure 3B:
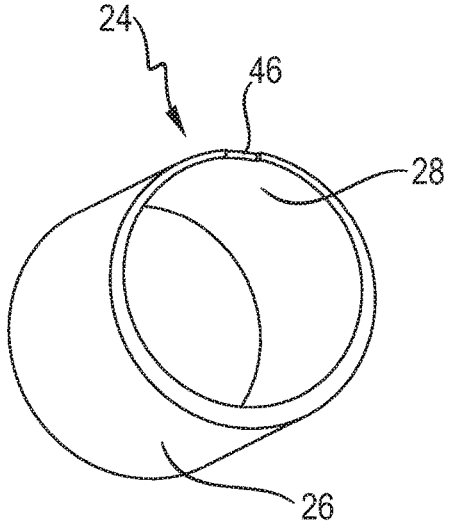

From FIG. 3*a* and FIG. 3*b*, it is possible to identify that the positioning element 24 has an eccentric embodiment. Here, the longitudinal axis 27 of the inner abutment area 28 is arranged with a parallel offset from the longitudinal axis 25 of the outer abutment area 26. According to FIG. 3*a*, a spacing A between the longitudinal axes 25, 27 is plotted. It corresponds to the distance of the impingement region 16 from the nominal position.

Figure 2A:
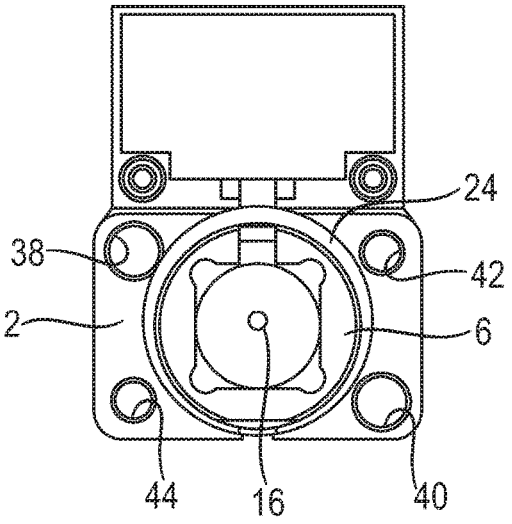
FIGS. 2*a* and 2*b* show different illustrations of the module together with a positioning element.
Figure 2B:
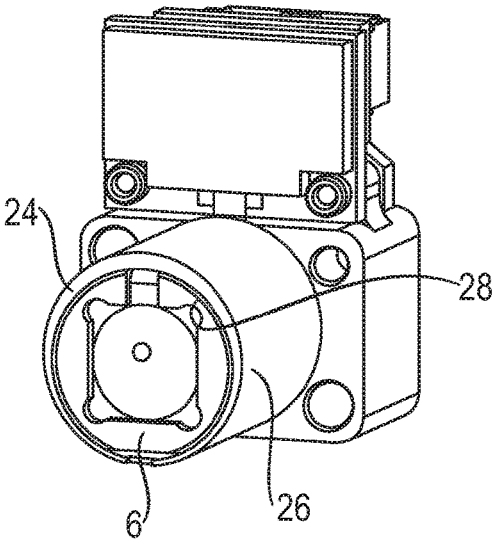

According to FIG. 2*a* and FIG. 2*b*, the positioning element 24 is furthermore positioned on the holding section 6 in the circumferential direction in such a way that the thickest wall region lies in the deviation direction of the impingement region 16. According to FIG. 2*a*, the impingement region 16, proceeding from the nominal position, is offset in the upward direction, which is why the thickest wall section of the positioning element 24 is likewise arranged at the top. Consequently, the positioning element 24 is positioned in such a way that the impingement region 16 lies on the longitudinal axis 25, see FIG. 3*a*, of the outer abutment area 26.

Figure 4A:
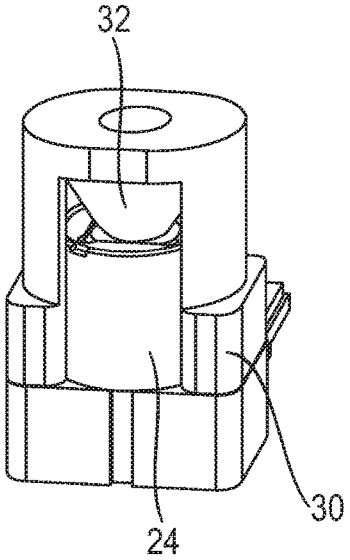
FIGS. 4*a* and 4*b* show different illustrations of an arrangement of a module together with an optics holder and optics.

In various embodiments, a set of different positioning elements according to FIG. 3*a* and FIG. 3*b* is provided, said different positioning elements firstly respectively having different spacings A and, secondly, there being provision among said positioning elements of a positioning element with no spacing A. Thus, provision can be made of positioning elements with a spacing A of 50 μm, 100 μm, 150 μm and 200 μm. Furthermore, provision can be made of a positioning element in which the longitudinal axes lie on one another and consequently no spacing A is present. This set of positioning elements 24 can be used to compensate a deviation of the impingement region 16 from the nominal position within a tolerance of +/−0.2 mm, wherein this can be achieved with a positioning accuracy of +/−25 μm. Consequently, after determining the distance of the impingement region 16 from the nominal position, the positioning element 24 in which the impingement region 16 has the closest proximity to the longitudinal axis 25 of the outer abutment area 26 of the positioning element 24, when the positioning element is aligned in the circumferential direction as explained above, is selected from the set of positioning elements 24. According to FIG. 4*a* and FIG. 4*b*, a component in the form of an optics holder 30 with optics 32 may be arranged on the positioning element 24 after the arrangement of the positioning element 24. To this end, the optics holder 30 has a receptacle 34, which, in sections, extends along a circular cylindrical area. Here, a diameter of the receptacle 34 is adapted to a diameter of the outer abutment area 26, see FIG. 3*a*, of the positioning element 24. According to FIG. 4*b*, the optical principal axis 36 of the optics 32 is always coaxial to the longitudinal axis of the outer abutment area 26, see FIG. 3*a*, of the positioning element 24. As a result of arranging the longitudinal axis of the outer abutment area 26 in such a way that the impingement region 16 lies thereon or at least is arranged as close to it as possible, the impingement region 16 consequently also lies on the optical principal axis 36 of the optics 32, see FIG. 4*a*, or approaches the latter to the greatest possible extent.

Moreover, the optics holder 30 according to FIG. 2*a* can be connected to the housing 2 via fastening recesses 38, 40 and/or 42, 44. The diameters thereof are selected in such a way here that the optics holder 30 may be fastened to the housing 2 in all positioning elements 24 of the set.

According to FIG. 3*a* and FIG. 3*b*, it is possible to identify that the positioning element 24 has a marking 46, which is introduced in the form of an axial groove, on the end face in the region of the thinnest wall.

Figure 4B:
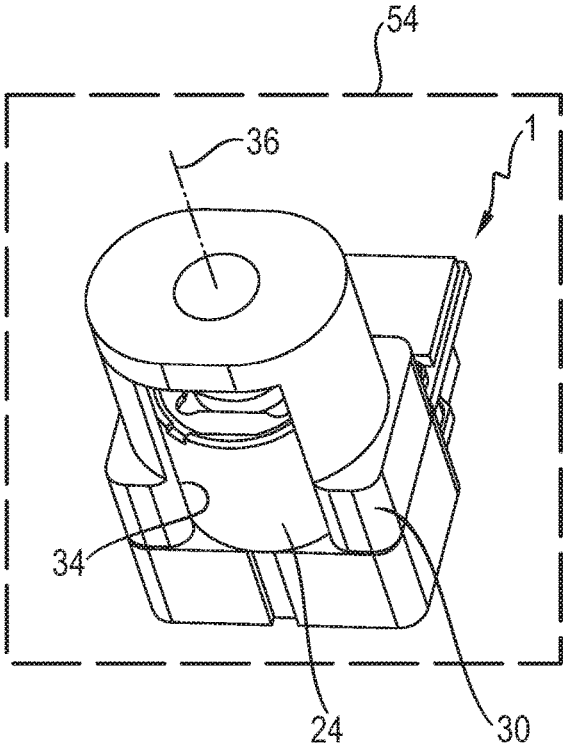
Figure 5:
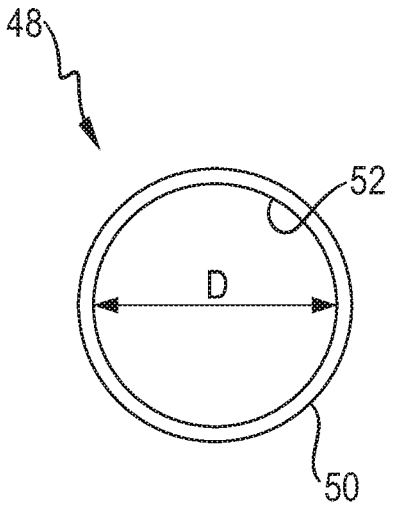
FIG. 5 shows a front view of a positioning element according to a further embodiment.

According to FIG. 5, a further embodiment of a positioning element 48 is illustrated. It has a circular cylindrical outer abutment area 50. Furthermore, it has an inner lateral area 52. Here, said inner lateral area is configured in such a way that the inner lateral area 52 encompasses the holding section 6 from FIG. 1 with play. Here, the play is selected in such a way that the positioning element 48 is displaceable in a plane which extends approximately transversely to the principal emission axis of the LARP module 1. According to FIG. 5, the inner lateral area 52 is configured here in an exemplary manner as a circular cylindrical area, the diameter D of which is greater than a diameter of the outer lateral area 22 of the holding section 6 in FIG. 1. Consequently, the longitudinal axis of the outer abutment area 50 can be flexibly arranged in such a way that the impingement region 16 lies in said outer abutment area or approaches the latter to the greatest possible extent. Following this, the positioning element 48 can be fastened to the housing 2, wherein this is effectuated, for example, by way of a joining method, e.g. by welding, adhesive bonding or soldering. Then, in turn, the optics holder 30 with the optics 32, see FIG. 4*b*, is positionable by way of the outer abutment area 50.

According to FIG. 4*b*, the LARP module is part of a vehicle headlamp 54 together with the optics holder 30 and the optics 32, said vehicle headlamp being illustrated in simplified fashion by means of a dashed line.

Disclosed is a module, e.g. a laser activated remote phosphor (LARP) module, having a housing in which a radiation source and a conversion element are arranged. Here, the conversion element is provided in a holding section. The holding section is encompassed by a positioning element and the module can then be inserted into a receptacle of a further component, for example an optics holder, by way of the positioning element. The optics holder is positionable in respect of an impingement region of excitation radiation of the radiation source on the conversion element by way of the positioning element.

LIST OF REFERENCE SIGNS

| | |
|---|---|
| LARP module | 1 |
| Housing | 2 |
| Block part | 4 |
| Holding section | 6 |
| Base area | 8 |
| Recess | 10 |
| Substrate | 12 |
| Phosphor | 14 |
| Impingement region | 16 |
| Actuation and electrical contacting | 18 |
| Ring section | 19 |
| End section | 20 |
| Outer lateral area | 22 |
| Positioning element | 24 |
| Longitudinal axis | 25, 27 |
| Outer abutment area | 26 |
| Inner abutment area | 28 |
| Optics holder | 30 |
| Optics | 32 |
| Receptacle | 34 |
| Optical principal axis | 36 |
| Fastening recess | 38, 40, 42, 44 |
| Marking | 46 |
| Positioning element | 48 |
| Outer abutment area | 50 |
| Inner lateral area | 52 |
| Vehicle headlamp | 54 |

While various aspects of the present disclosure have been particularly shown and described with reference to specific embodiments, it should be understood by those skilled in the art that various changes in form and detail may be made therein without departing from the spirit and scope of the present disclosure as defined herein. The scope of the various aspects are thus indicated by the present disclosure and all changes which come within the meaning and range of equivalency of the present disclosure are therefore intended to be embraced.

What is claimed is:

1. A module, comprising:

a housing in which a radiation source is arranged, the radiation source being configured to emit an excitation radiation by virtue of a conversion element disposed downstream of the radiation source, the conversion element being configured to convert, at least in part, the excitation radiation, wherein the conversion element is fastened to a holding section of the housing, the holding section is encompassed by a positioning element, a receptacle of a component is adapted to the positioning element, the component is disposed downstream of the module, and the housing is positionable in the receptacle in order to position the component with respect to an impingement region of the excitation radiation on the conversion element.

2. The module of claim 1, wherein a position of the positioning element is adjustable.

3. The module of claim 1, wherein the positioning element is a first type of positioning element or a second type of positioning element, and the first type of positioning element and the second type of positioning element are different.

4. The module of claim 1, wherein the positioning element has an outer abutment area for positioning in the receptacle, the abutment area includes a circular cylindrical section, a plurality of circular cylindrical sections, or a circular cylindrical area, and a longitudinal axis of the abutment area extends through the impingement region on the conversion element or substantially approaches the impingement region without extending through the impingement region.

5. The module of claim 1, wherein the positioning element is socket-shaped and encompasses the holding section.

6. The module of claim 1, wherein the holding section is socket-shaped and encompasses a beam path between the radiation source and the conversion element.

7. The module of claim 1, wherein the holding section has an outer lateral area, and the outer lateral area includes a circular cylindrical section or a circular cylindrical area.

8. The module of claim 4, wherein the positioning element has an inner abutment area for arranging the positioning element on an outer lateral area of the holding section, the inner abutment area includes a circular cylindrical section, a plurality of circular cylindrical sections, or a circular cylindrical area, wherein longitudinal axes of the inner abutment area and outer abutment area extend with a parallel spacing from one another or the longitudinal axes of the inner abutment area and the outer abutment area are coaxial.

9. The module of claim 4, wherein the positioning element has an inner lateral area, and there is play between the inner lateral area of the positioning element and an outer lateral area of the holding section.

10. The module of claim 1, wherein the positioning element has a marking.

11. The module of claim 1, wherein the module is a laser activated remote phosphor module.

12. A set comprising a plurality of different positioning elements for the module of claim 1, wherein a respective positioning element of the plurality of different positioning elements comprises an outer abutment area and an inner abutment area, which respectively include a circular cylindrical section, a plurality of circular cylindrical sections, or a circular cylindrical area, in the plurality of different positioning elements, longitudinal axes of the inner abutment area and the outer abutment area respectively extend with a parallel spacing from one another or the longitudinal axes of the inner abutment area and the outer abutment area extend with a parallel spacing from one another in at least one positioning element of the plurality of different positioning elements and the longitudinal axes of the inner abutment area and the outer abutment area are coaxial in a particular positioning element of the plurality of different positioning elements, and the plurality of different positioning elements differ in terms of spacing of the longitudinal axes.

13. An arrangement, comprising:

a module, including a housing in which a radiation source is arranged, the radiation source being configured to emit an excitation radiation by virtue of a conversion element disposed downstream of the radiation source, the conversion element being configured to convert, at least in part, the excitation radiation; and a component including a receptacle having an abutment area for a positioning element, the component being disposed downstream of the module, wherein the conversion element is fastened to a holding section of the housing, the holding section is encompassed by the positioning element, and the housing is positionable in the receptacle in order to position the component with respect to an impingement region of the excitation radiation on the conversion element.

14. A headlamp for a vehicle, wherein the headlamp comprises the arrangement of claim 13.

15. A method for producing a module, the module comprising a housing in which a radiation source is arranged, the radiation source being configured to emit an excitation radiation by virtue of a conversion element disposed downstream of the radiation source, the conversion element being configured to convert, at least in part, the excitation radiation, wherein the conversion element is fastened to a holding section of the housing, the holding section is encompassed by a positioning element, a receptacle of a component is adapted to the positioning element, the component is disposed downstream of the module, and the housing is positionable in the receptacle in order to position the component with respect to an impingement region of the excitation radiation on the conversion element; and the method comprising:

measuring a distance between the impingement region of the excitation radiation on the conversion element and a center point of a cross section of an outer lateral area of the holding section in a radial direction;

measuring a deviation direction of the impingement region proceeding from the center point of the cross section of the outer lateral area of the holding section in the radial direction; and selecting the positioning element from a set comprising a plurality of different positioning elements for the module, or arranging the positioning element with play, wherein a respective positioning element of the plurality of different positioning elements comprises an outer abutment area and an inner abutment area, which respectively include a circular cylindrical section, a plurality of circular cylindrical sections, or a circular cylindrical area, in the plurality of different positioning elements, longitudinal axes of the inner abutment area and the outer abutment area respectively extend with a parallel spacing from one another or the longitudinal axes of the inner abutment area and the outer abutment area extend with a parallel spacing from one another in at least one positioning element of the plurality of different positioning elements and the longitudinal axes of the inner abutment area and the outer abutment area are coaxial in one positioning element of the plurality of different positioning elements, and the plurality of different positioning elements differ in terms of spacing of the longitudinal axes.

* * * * *